US007243951B2

(12) United States Patent
Cote et al.

(10) Patent No.: US 7,243,951 B2
(45) Date of Patent: Jul. 17, 2007

(54) DURABLE SECURITY DEVICES AND SECURITY ARTICLES EMPLOYING SUCH DEVICES

(75) Inventors: Paul F. Cote, Hollis, NH (US); Stephen B. Curdo, Hollis, NH (US); Gerald J. Gartner, Hollis, NH (US); Daniel G. Leeds, Manchester, NH (US); Brian C. Page, Hooksett, NH (US); Gary R. Wolpert, Mason, NH (US); Timothy T. Crane, Windsor, MA (US)

(73) Assignee: Technical Graphics, Inc., Milford, NH (US)

( * ) Notice: Subject to any disclaimer, the term of this patent is extended or adjusted under 35 U.S.C. 154(b) by 713 days.

(21) Appl. No.: 10/643,445

(22) Filed: Aug. 19, 2003

(65) Prior Publication Data

US 2005/0040641 A1 Feb. 24, 2005

(51) Int. Cl.
*D21H 21/42* (2006.01)

(52) U.S. Cl. ..... 283/72; 283/83; 283/94; 428/192; 428/194; 428/201

(58) Field of Classification Search ..... 428/195.1, 428/192, 194, 201; 283/82–83, 91, 72, 94
See application file for complete search history.

(56) References Cited

U.S. PATENT DOCUMENTS

| | | | | |
|---|---|---|---|---|
| 4,044,231 | A | 8/1977 | Beck et al. | |
| 4,183,989 | A | 1/1980 | Tooth | |
| 4,242,378 | A * | 12/1980 | Arai | 427/264 |
| 4,446,204 | A | 5/1984 | Kaule et al. | |
| 4,511,616 | A | 4/1985 | Pitts et al. | |
| 4,534,398 | A | 8/1985 | Crane | |
| 4,584,529 | A | 4/1986 | Aoyama | |
| 4,631,222 | A | 12/1986 | Sander | |
| 4,631,223 | A | 12/1986 | Sander | |
| 4,652,015 | A | 3/1987 | Crane | |
| 4,869,778 | A | 9/1989 | Cote | |
| 4,941,687 | A | 7/1990 | Crane | |
| 4,943,093 | A | 7/1990 | Melling et al. | |
| 4,960,651 | A | 10/1990 | Pettigrew et al. | |
| 4,980,569 | A | 12/1990 | Crane et al. | |
| 5,002,636 | A * | 3/1991 | Crane | 162/104 |
| 5,016,919 | A | 5/1991 | Rotondo | |

(Continued)

FOREIGN PATENT DOCUMENTS

| | | |
|---|---|---|
| DE | 195 48 528 A | 6/1997 |
| JP | 61-115187 | 6/1986 |
| WO | WO 93/01057 | 1/1993 |

OTHER PUBLICATIONS

Tucker, Richard, "Portals and Tagsa make their mark in secure labels", article source and date unknown.
De La Rue Holographics Ltd., "The Mark of Authenticity" brochure, Designed and Produced by Osprey RMA, Hampshire, England date unknown.

*Primary Examiner*—Cathy F. Lam
(74) *Attorney, Agent, or Firm*—Holland & Bonzagni, P.C.; Mary R. Bonzagni, Esq.

(57) ABSTRACT

Durable security devices that are resistant to chemical attack and mechanical degradation and security articles employing such devices, are provided. By way of the durable security device of the present invention, opposing longitudinal borders adjacent an information-bearing layer are sealed, thereby preventing corrosive and/or degrading materials from reaching this layer through these sealed borders. In a preferred embodiment, at least a portion of the information-bearing layer is fully encapsulated, thereby rendering this portion or layer and the information conveyed thereby, impervious to chemical attack.

35 Claims, 3 Drawing Sheets

U.S. PATENT DOCUMENTS 5,042,842 A 8/1991 Green et al.
5,043,201 A 8/1991 Cote
5,068,008 A * 11/1991 Crane ..... 216/33
5,082,842 A 1/1992 Widmer
5,093,184 A 3/1992 Edwards
5,112,672 A 5/1992 Kaule et al.
5,113,062 A 5/1992 Fujita et al.
5,190,318 A 3/1993 Mantegazza
5,196,681 A 3/1993 Mantegazza
5,265,916 A 11/1993 Coe
5,279,403 A 1/1994 Harbaugh et al.
5,284,363 A 2/1994 Gartner et al.
5,308,992 A 5/1994 Crane et al.
5,354,099 A 10/1994 Kaule et al.
5,383,687 A 1/1995 Suess et al.
5,388,862 A 2/1995 Edwards
5,394,969 A 3/1995 Harbaugh
5,417,316 A 5/1995 Harbaugh
5,419,424 A 5/1995 Harbaugh
5,447,335 A 9/1995 Haslop
5,457,382 A 10/1995 Stein
5,474,638 A 12/1995 Kohlhammer et al.
5,486,022 A 1/1996 Crane
5,516,153 A 5/1996 Kaule
5,535,871 A 7/1996 Harbaugh
5,543,911 A 8/1996 Jeffers
5,545,885 A 8/1996 Jagielinski
5,582,927 A 12/1996 Andricacos et al.
5,583,631 A 12/1996 Lazzerini
5,599,047 A 2/1997 Kaule et al.
5,601,931 A 2/1997 Hoshino et al.
5,614,824 A 3/1997 Dames et al.
5,639,126 A 6/1997 Dames et al.
5,697,649 A 12/1997 Dames et al.
5,786,587 A 7/1998 Colgate, Jr.
5,803,503 A 9/1998 Kaule et al.
5,949,050 A 9/1999 Fosbenner et al.
6,086,708 A 7/2000 Colgate, Jr.
6,146,773 A 11/2000 Kaule
6,168,851 B1 1/2001 Kubota
6,255,948 B1 7/2001 Wolpert et al.
6,316,082 B1 11/2001 Tomkins et al.
6,336,988 B1 1/2002 Enlow et al.
6,343,745 B1 2/2002 Bohm et al.
6,364,983 B1 4/2002 Kay
6,376,094 B1 4/2002 Dames et al.
6,440,522 B1 8/2002 Duschek et al.
6,454,166 B1 9/2002 Stenzel et al.
6,474,695 B1 11/2002 Schneider et al.
6,491,324 B1 12/2002 Schmitz et al.
6,549,131 B1 * 4/2003 Cote et al. ..... 340/572.1
2002/0014967 A1 2/2002 Crane et al.

* cited by examiner

DURABLE SECURITY DEVICES AND SECURITY ARTICLES EMPLOYING SUCH DEVICES

FIELD OF THE INVENTION

The present invention generally relates to security devices that are resistant to chemical attack and mechanical degradation and to security articles having at least one such security device partially or fully embedded therein and/or mounted thereon.

BACKGROUND OF THE INVENTION

It is known that secure documents or instruments may be rendered less susceptible to forgery or counterfeiting by including security features in various forms within the body of the document. In fact, the security or integrity of a document or instrument will increase with the number of separate and distinct security features that it employs.

Many security papers and other items of value include a security device or element, such as a security thread, disposed on or within the document. The security device typically includes one or more security features, such as metallic, magnetic and/or luminescent security features that serve to authenticate the security paper and prevent or deter counterfeiting.

A common type of security thread includes metal-formed characters or indicia disposed on a plastic carrier substrate. Such threads, which are coated with a very thin (e.g., 300 to 500 angstrom) layer of metal, such as aluminum, and are then demetallized, display either: discrete metal characters as currently used in United States currency; negative or reverse-image characters as currently used in the new Euro currency; or a repeating pattern of isolated metal blocks containing negative or reverse-image characters as described in U.S. Pat. No. 5,486,022 and as used in Indian and Venezuelan currencies. These threads are visually detectable in transmitted light by members of the public and may be machine detectable by conventional thread detectors that detect the presence or absence of conductive features on the threads. The repeating patterns of the threads described in U.S. Pat. No. 5,486,022 and employed in Indian and Venezuelan currencies are machine readable as well as machine detectable.

Demetallized threads have well known advantages over printed security threads. Due to the presence of a reflective metal layer, beneficial optical effects are produced under circumstances where the thread is entirely buried in paper as well as when partially exposed as in the case of windowed thread. There are further advantages to the metallic layer when security threads are authenticated during banknote sorting. The presence of either a continuous metal layer or a specifically encoded patterned metal layer can be detected on the basis of conductivity.

A known disadvantage of demetallized threads is their susceptibility to corrosive effects during paper manufacturing and in circulating banknotes. More specifically, any metal extending to the edge of the thread, even when protected by a laminate or transparent coating, acts as a wick for chemicals that cause corrosion or degradation of the metal layer. As a consequence threads in banknotes exposed to even weak alkali solutions such as used in common household laundries may lose all or part of their metal layer via corrosion from the edges inward.

A need therefore exists for a security device that is resistant to chemical attack.

It is therefore an object of the present invention to provide such a durable security device.

It is a more particular object to provide a security device for use in security articles such as bank notes and the like, that matches or exceeds the durability of the security article.

It is another object of the present invention to provide a security article having at least one durable security device at least partially embedded therein and/or mounted thereon.

SUMMARY

The present invention therefore provides a security device comprising:

(a) at least one support layer having a surface comprising a central longitudinal band or strip and opposing longitudinal borders;

(b) at least one information-bearing layer disposed on the central band or strip of the support layer surface; and (c) at least one protective layer disposed on the information-bearing layer(s) and on the opposing longitudinal borders of the support layer surface, wherein, the protective layer(s) is adhered to at least the opposing longitudinal borders of the support layer surface.

The present invention further provides a security article having at least one security device, as defined hereinabove, at least partially embedded therein and/or mounted thereon.

Other features and advantages of the invention will be apparent to one of ordinary skill from the following detailed description and accompanying drawings.

Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

Particular features of the disclosed invention are illustrated by reference to the accompanying drawings in which.

DESCRIPTION OF THE PREFERRED EMBODIMENTS

Figure 1:
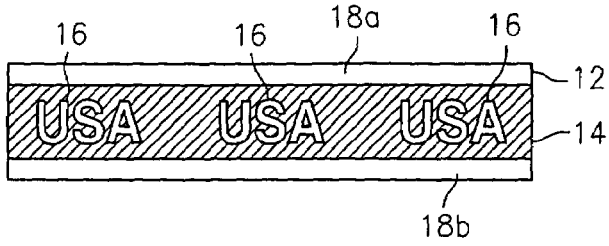
FIGS. 1 to 8 are plan views of different embodiments of the information-bearing layer formed on the support layer surface of the inventive durable security device.

The present invention serves to address the problem of providing a durable security device, one that is resistant to chemical attack and mechanical degradation. The solution to this problem resides in the discovery that sealing the support and protective layers along opposing longitudinal borders adjacent to the information-bearing layer will prevent corrosive and/or degrading materials from reaching the information-bearing layer through these sealed borders. As a result, the information conveyed by way of the information-bearing layer and thus the integrity of the security device is preserved.

In a preferred embodiment, at least a portion of the information-bearing layer is fully encapsulated by the support and protective layers, rendering this portion or layer and the information conveyed thereby, impervious to chemical attack.

The inventive security device will be described herein below mainly as a security thread used in association with banknotes. The invention, however, is not so limited. The durable security device of the present invention can be utilized in a variety of different forms (e.g., patches, stripes) with any document or means of identification for authentication purposes.

The support layer of the durable security device is a light-transmitting support layer that has a thickness ranging from about 8 to about 26 microns (preferably from about 10 to about 15 microns).

In a preferred embodiment, the support layer is formed using one or more essentially colorless polymers selected from the group of polyester, polypropylene, polyethylene, polyethylene terephthalate, and mixtures thereof. In a more preferred embodiment, the support layer is a polyester film.

In another preferred embodiment, the support layer is colored and/or luminescent and, in yet another preferred embodiment, the support layer provides adhesive properties to bond the security device into or onto paper.

The information-bearing layer(s) is either a continuous or discontinuous strip that is formed along the entire length of the support layer surface. The thickness of the information-bearing layer(s) ranges from about 0.001 to about 0.01 microns.

The information conveyed by the information-bearing layer(s) may be visually perceivable information (e.g., letters, numbers, symbols) and/or machine-detectable and optionally machine-readable information (e.g., a plurality of metal regions).

In a preferred embodiment, the information-bearing layer(s) is an opaque strip formed using materials selected from the group of aluminum (Al), chromium (Cr), cobalt (Co), copper (Cu), gold (Au), iron (Fe), nickel (Ni), silver (Ag), alloys of two or more of the aforementioned materials, and alloys that produce an opaque layer upon sputtering, vacuum deposition, plasma coating and the like. In a more preferred embodiment, the information-bearing layer(s) is formed using aluminum. In another more preferred embodiment, the information-bearing layer(s) is formed using a magnetic metal such as nickel or a nickel/cobalt alloy.

Several embodiments of the information-bearing layer(s) are shown in FIGS. 1 to 8. In the figures or drawings, reference numeral 10 has been used to generally designate the security device of the present invention, while reference numerals 12 and 14 have been used to denote the support layer and the information-bearing layer(s), respectively.

In a first embodiment, and as best shown in FIG. 1, the information-bearing layer 14 is a continuous metal or metallic strip and the information conveyed thereby is present in the form of recesses in the metal or metallic strip that adopt the shape of negative or reverse-image characters 16. Metal-free borders 18*a*, 18*b*, preferably ranging from about 0.1 to about 2 millimeters (mm) in width, are provided along the length of support layer 12.

Figure 2:
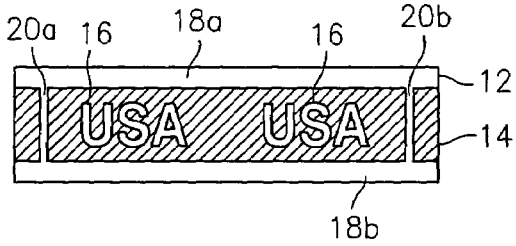
Figure 3:
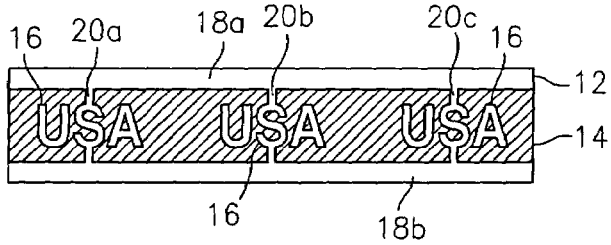

In a second embodiment, and as best shown in FIG. 2, the information-bearing layer 14 is a discontinuous metal or metallic strip that is provided with two breaks (i.e., non-metal regions or cross thread stops) 20*a*, 20*b*, located near opposing ends of the strip. The cross thread stops extend across the entire width of layer 14 and limit loss of metal from the ends of security device 10.

Figure 4:
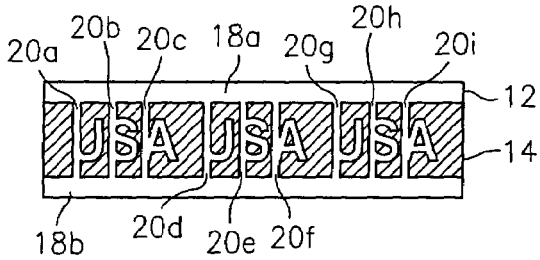
Figure 5:
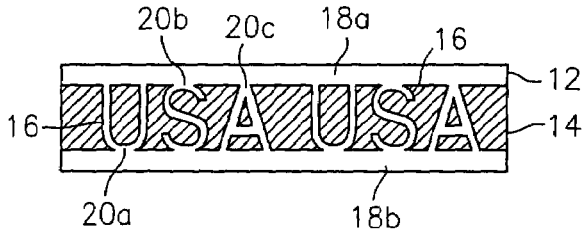
Figure 6:
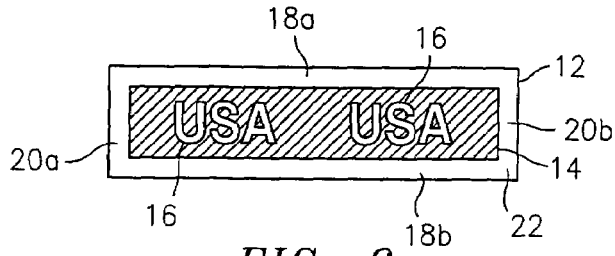

The cross thread stops 20*a*, 20*b* require a dimension no greater than 0.1 millimeters (mm) in width and, as best shown in FIG. 4, can be incorporated into traditional text or graphics such that the longest potentially exposed area at the end of security device 10 is a single character width.

Figure 7:
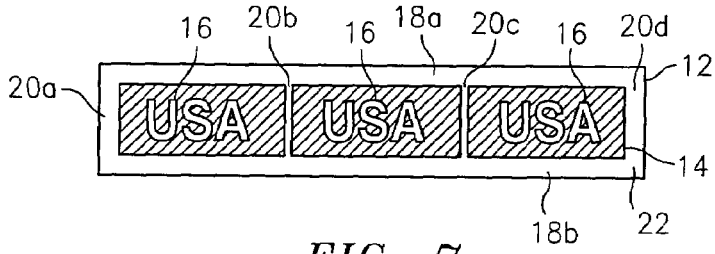

The embodiments shown in FIGS. 3 to 7 represent variations of the FIG. 2 embodiment, where the breaks or cross thread stops 20 either: form part of the negative or reverse-image characters 16 (FIGS. 3 to 5); are positioned at opposing ends of the strip thereby forming a metal-free perimeter 22 around layer 14 (FIG. 6); or are positioned at opposing ends and periodically along the length of strip 14 (FIG. 7).

The breaks or cross thread stops 20 shown in FIGS. 3 to 5 and 7 serve a dual purpose. In addition to providing stops for corrosive attacks from the ends of device 10, these breaks or cross thread stops 20 also form part of a conductive code. Examples of suitable conductive codes and means for the machine detection and reading of such codes are described in detail in U.S. Pat. No. 5,486,022.

Figure 8:
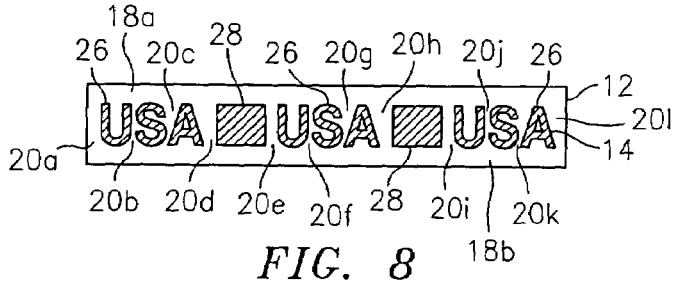

FIG. 8 shows yet a further embodiment where information-bearing layer 14 is a discontinuous metal or metallic strip that is provided with metal characters 26 and metal blocks 28 along with breaks 20*a-l* on opposite sides of each metal character 26.

As alluded to above, information-bearing layer 14 may also take the form of a multi-layer structure or laminate. In one such embodiment (not shown), the information-bearing layer 14 is a diffractive, optically variable layer or laminate comprising, for example, a metallized diffractive film with holographic icon images, denomination numerals and/or kinetic effects. In another such embodiment (not shown), the information-bearing layer 14 is a multi-layer interference filter having as one of its layers an opaque reflective metal. When contained in the security devices of the present invention, these diffractive and metal layers maintain their colorful, diffractive effect even when subjected to chemical attack or the laundering process.

In another such embodiment (not shown), the information-bearing layer 14 comprises a first magnetic information-bearing layer and a second metal information-bearing layer. As will be readily appreciated by those skilled in the art, the magnetic information-bearing layer offers additional machine testable features. The combined use of metal and magnetic materials in security threads and the machine detection and reading of codes formed thereby are described in detail in U.S. Pat. No. 6,255,948 B1 and in U.S. Patent Application Publication No. 20020014967 A1.

The metal-free borders 18*a*, 18*b*, and the information conveyed by information-bearing layer 14 (e.g., indicia 16, cross thread stops 20) may be formed by any one of a number of methods including, but not limited to, (1) methods involving selective metallization by electrodeposition, directly hot stamping onto the support layer 12 or using a mask or template in a vacuum metallizer, and (2) methods involving metallization and selective demetallization by chemical etching, laser etching and the like. It is preferred that the metal-free borders 18*a*, 18*b* and the information be formed on the support layer 12 by a resist and etch technique as described in U.S. Pat. No. 4,869,778. It is also preferred that the metal deposited on the support layer 12 have a thickness of from about 100 to about 500 angstroms and more preferably have a thickness of from about 200 to about 300 angstroms.

The protective layer of the present invention is a light-transmitting protective layer having a thickness ranging from about 1 to about 12 microns. The protective layer may take the form of a protective film having a thickness ranging from about 3 to about 12 microns (preferably from about 4 to about 8 microns) or a printed coating having a thickness ranging from about 1 to about 12 microns. By way of the present invention, it has been discovered that films or coatings having thicknesses within the ranges noted above effectively act as barriers to chemical penetration, thereby protecting the information-bearing layer(s) 14 from, for example, dissolution after soaking in caustic, acetone or bleach.

In a preferred embodiment, the protective layer is formed using one or more essentially colorless polymers selected from the group of polyester, polypropylene, polyethylene, polyethylene terephthalate, and mixtures thereof. In a more preferred embodiment, the protective layer is a laminated polyester film.

In another preferred embodiment, the protective layer is colored and/or luminescent and, in yet another preferred embodiment, the protective layer provides adhesive properties to bond the security device 10 into or onto paper.

The protective layer may be laminated to the structure formed by the information-bearing layer 14 and the support layer 12 by using a light-transmitting adhesive. By removing metal from the edges and replacing the metal with laminating adhesive there is no corrosive wicking and device 10 can withstand immersion in strong alkali, acids, and any agents that would be reactive with the metal or metallic information-bearing layer 14.

Light-transmitting laminating adhesives, suitable for use in the practice of the present invention, guarantee good bond strength between the protective layer and (i) information-bearing layer 14, (ii) metal-free borders 18*a*, 18*b* and, in some embodiments, also (iii) support layer 12. Such materials should be light stable, resistant to ageing, free from fine coagulum and exhibit little foaming. Examples of such light-transmitting laminating adhesives include, but are not limited to, acrylic polymers and copolymers, modified acrylic polymers and copolymers and polyesters. Aqueous systems of these materials are preferred so as to avoid problems associated with solvent wastes and solvent emissions. In a preferred embodiment, the light-transmitting laminating adhesive is an aqueous acrylic polymer dispersion.

Figure 9:
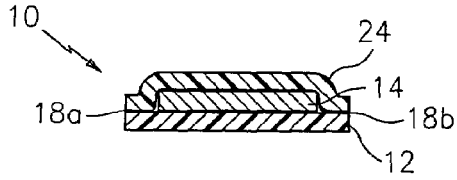
FIG. 9 is a cross-sectional end view of one embodiment of the durable security device of the present invention.
Figure 10:
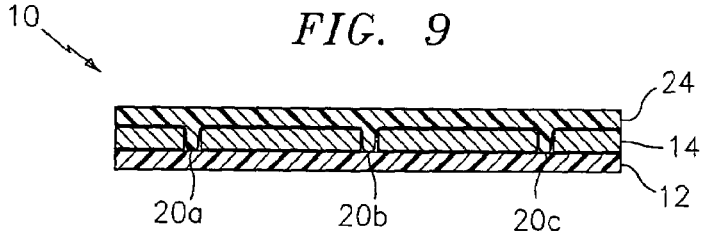
FIG. 10 is a cross-sectional side view of another embodiment of the inventive durable security device where the information-bearing layer is a discontinuous layer that extends across the entire length of the security device.

As shown in FIG. 9, protective layer 24 wraps around information-bearing layer 14 and adheres to support layer 12 along the metal-free borders 18*a*, 18*b*. In a preferred embodiment, and as best shown in FIG. 10, protective layer 24 also adheres to support layer 12 at the breaks or cross thread stops 20*a*, 20*b*, 20*c* of information-bearing layer 14, thereby rendering the encapsulated portion(s) of layer 14 impervious to chemical attack.

Figure 11:
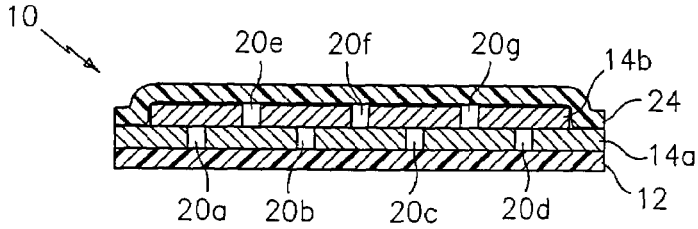
FIG. 11 is a cross-sectional side view of yet another embodiment of the present invention where two registered, discontinuous information-bearing layers extend across the entire length of the security device.

In another preferred embodiment, and as best shown in FIG. 11, both the support layer 12 and the protective layer 24 have an information-bearing layer 14*a*, 14*b* in the form of a discontinuous metal strip formed along its entire length. The information-bearing layers 14*a*, 14*b* are laminated together in register with a light-transmitting laminating adhesive such that the metal regions on one layer 14*a* are lined up with e.g. the breaks or gaps 20*e-g* on the other layer 14*b*. Even though the information-bearing layers 14*a*, 14*b* are discontinuous, the metal regions overlap for a length ranging from about 1 to about 3 millimeters (mm). It is noted that the laminating adhesive will prevent corrosive and/or degrading materials from wicking through metal end regions to overlapped metal regions. The resulting security device 10 adopts the appearance of a continuously metallized thread or strip while insulating the information-bearing layers 14*a*, 14*b* from chemical attack. Conductivity, in this preferred embodiment, results from capacitive coupling between the layers across the adhesive laminating layer.

Figure 12:
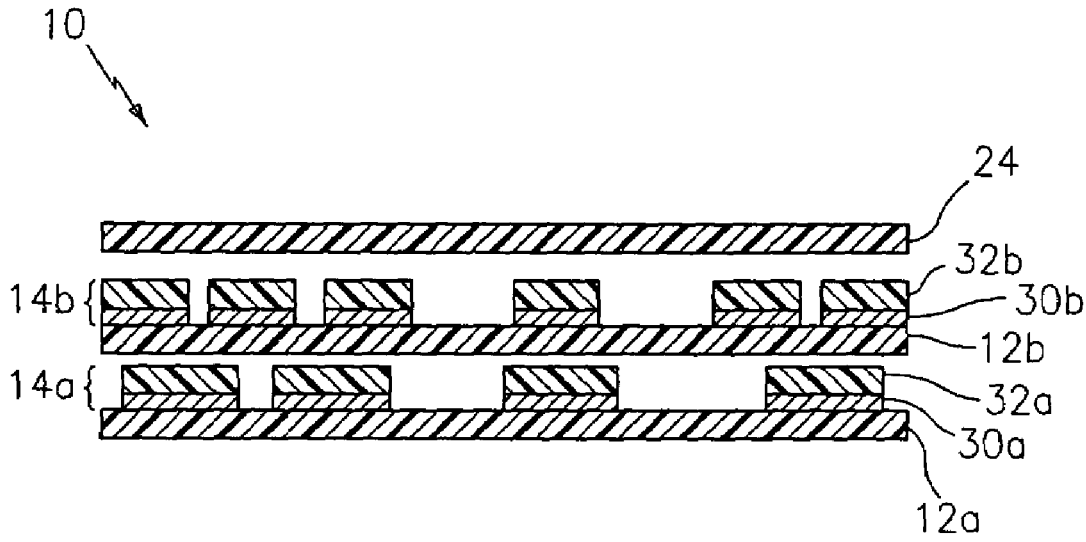
FIG. 12 is an exploded, cross-sectional side view of yet another embodiment of the present invention where two support layers are used in constructing the durable security device of the present invention.

In yet another preferred embodiment, and as best shown in FIG. 12, two support layers 12*a*, 12*b* are used in constructing security device 10, with each support layer 12*a*, 12*b* having an information-bearing layer 14*a*, 14*b* formed along its entire length. Information-bearing layers 14*a*, 14*b* are each formed using a resist and etch technique, as described above, resulting in a formed pattern of indicia made up of a first metal layer 30*a*, 30*b* and a second resist (e.g., clear chemical resist) layer 32*a*, 32*b*. The relative arrangement of the indicia patterns or metal regions on layers 12*a*, 12*b* is not limited. In this embodiment, support layer 12*b* also serves as a protective or barrier layer for information-bearing layer 14*a*. Upon lamination of the respective layers, protective layer 24 would adhere to support layer 12*b* along its metal-free borders, as well as, at the breaks or cross thread stops of information-bearing layer 14*b*. Similarly, support layer 12*b* would adhere to support layer 12*a* along its metal-free borders, as well as, at the breaks or cross thread stops of information-bearing layer 14*a*.

The security device 10 of the present invention may include additional layers or coatings, provided however that any such additional layers or coatings do not interfere with the visual perception of the information conveyed by way of the information-bearing layer 14 and/or the signals seen by authenticity testing devices. Contemplated additional layers or coatings include light-transmitting adhesive layers on either or both sides of device 10 that facilitate the incorporation of the device into or onto security documents and fluorescent coatings made up of eosin, fluorescein, fluorspar, fuchsin, sulphate of quinine, calcium sulphide, Neodymium salicylate, Samarium gluconate, Yttrium salicylate and the like.

The security device 10, as illustrated for example in FIG. 10, may be produced by applying a layer of aluminum via vacuum deposition to one side of a polyester film. The aluminum is then printed with a resist in a desired pattern and the resist cured by evaporation and/or the application of heat and/or ultraviolet (UV) light. In order to demetallize the aluminum coated polyester film, the film is flooded with hot sodium hydroxide (NaOH) solution. The NaOH solution is preferably prepared at concentrations ranging from about 5 to about 50% by weight NaOH and is applied at temperatures of from about 25 to about 80° C. By way of this treatment the regions of aluminum that are not protected by the cured resist are dissolved. The film is then rinsed with a water/acid solution or other buffered solution to neutralize the surface of the substrate and prevent further etching The web is then dried leaving the selectively metallized pattern on one side, this pattern corresponding to the pattern of the resist applied by the printing process. A polyester protection film is then laminated to the demetallized film using a light-transmitting adhesive.

Once the laminated film is prepared, it can be slit to provide narrow threads or strips which are preferably at least 0.8 mm in width, preferably from about 1 to about 5 mm, or even up to 6 or 8 mm in width.

The security article of the present invention is preferably a security paper and the security device 10, which is preferably in the form of a security thread, is either wholly embedded within the paper, or is partially embedded within the paper with portions thereof being exposed at the surface of the paper at spaced intervals along the thread's length at windows or apertures in the paper.

The security thread 10 may be at least partially incorporated in security papers during manufacture by techniques commonly employed in the papermaking industry. For example, the inventive thread 10 may be pressed within wet paper fibers while the fibers are unconsolidated and pliable, as taught by U.S. Pat. No. 4,534,398, resulting in the thread being totally embedded in the resulting paper. The thread 10 may also be fed into a cylinder mold papermaking machine, cylinder vat machine, or similar machine of known type, resulting in partial embedment of the thread within the body of the finished paper (i.e., windowed paper).

In addition to the above, the security device 10 of the present invention may be mounted on the surface of security papers either during or post manufacture. Mounting of the device 10 may be achieved by any number of known techniques including: applying a pressure-sensitive adhesive to a surface of the device 10 and pressing the device 10 to the surface of the paper; and applying a heat activated adhesive to a surface of the device 10 and applying the device 10, using thermal transfer techniques, to the surface of the paper.

As stated above, the durability of security device 10 matches or exceeds the durability of host security articles such as bank notes and the like. In fact, test samples comprising security device 10, in the form of a security thread employing a metallized, diffractive information-bearing layer 14, partially embedded in a security paper, satisfied a number of different durability tests. More specifically, in repeated laundry testing, approximately 98% of the metal of layer 14 in the test samples remained intact. Chemical resistance testing, where the test samples were immersed in: undiluted ethyl acetate for ½ hour; undiluted acetone for 24 hours; 5% sodium hypochlorite for 24 hours; 2% sodium hydroxide for 24 hours; undiluted trichloroethylene for ½ hour; boiling water for ½ hour; 2% biological detergent at a temperature of 95° C. for ½ hour; or 0.5% industrial wash powder plus 1% sodium carbonate ($Na_2CO_3$) at a temperature of 95° C. for ½ hour, resulted in 100% of the metal remaining intact. Similar results were obtained when the test samples were subjected to mechanical testing. For example, although wrinkles in security device 10 were observed when the test samples were subjected to IGT Crumpling (dry) 8× and IGT Crumpling (wet) 8×, no loss of metal occurred. Similarly, although surface dullness of the information-bearing layer 14 was observed when the test samples were subjected to Taber Dual Abraser (10 revolutions), no loss of metal occurred. Finally, no change in appearance or metal content occurred when the test samples were subjected to Graminski Flex Tester (2,000 cycles).

While various embodiments of the present invention have been described above, it should be understood that they have been presented by way of example only, and not limitation. Thus, the breadth and scope of the present invention should not be limited by any of the exemplary embodiments.

Having thus described the invention, what is claimed is:

1. A durable security device comprising:

(a) at least one support layer having a surface comprising a central longitudinal band or strip and opposing longitudinal borders;

(b) at least one information-bearing layer disposed on the central band or strip of the support layer surface, wherein the information-bearing layer(s) has a thickness of from about 0.001 to about 0.01 micron; and (c) at least one protective layer disposed on the information-bearing layer(s) and on the opposing longitudinal borders of the support layer surface, wherein the protective layer(s) is adhered to at least the opposing longitudinal borders of the support layer surface.

2. The durable security device of claim 1, wherein the protective layer(s) has a thickness ranging from about 1 to about 12 microns.

3. The durable security device of claim 1, wherein the support layer(s) and the protective layer(s) are light-transmitting layers that are formed using one or more essentially colorless polymers selected from the group of polyester, polypropylene, polyethylene, polyethylene terephthalate, and mixtures thereof.

4. The durable security device of claim 3, wherein the light-transmitting layers are formed using polyester.

5. The durable security device of claim 3, wherein the light-transmitting support layer(s) is a colored, light-transmitting support layer(s).

6. The durable security device of claim 3, wherein the light-transmitting protective layer(s) is a colored, light-transmitting protective layer(s).

7. The durable security device of claim 3, wherein the light-transmitting support layer(s) is a luminescent, light-transmitting support layer(s).

8. The durable security device of claim 3, wherein the light-transmitting protective layer(s) is a luminescent, light-transmitting protective layer(s).

9. The durable security device of claim 1, wherein the information-bearing layer(s) is a continuous strip that is formed along the entire length of the support layer surface.

10. The durable security device of claim 1, wherein the information-bearing layer(s) is a discontinuous strip that is formed along the entire length of the support layer surface.

11. The durable security device of claims 9 or 10, wherein the strip contains visually perceivable information, machine-detectable information, and optionally, machine-readable information.

12. The durable security device of claims 9 or 10, wherein the strip is formed using one or more materials selected from the group of aluminum, chromium, cobalt, copper, gold, iron, nickel, silver, alloys of two or more of the aforementioned materials, and alloys that produce an opaque layer upon sputtering, vacuum deposition, or plasma coating.

13. The durable security device of claim 12, wherein the strip is formed using aluminum.

14. The durable security device of claim 9, wherein the information-bearing layer(s) is a continuous metal or metallic strip having recesses in the shape of negative or reverse-image characters formed therein.

15. The durable security device of claim 10, wherein the information-bearing layer(s) is a discontinuous metal or metallic strip having at least one non-metal region extending across the entire width of the strip.

16. The durable security device of claim 15, wherein the discontinuous metal or metallic strip is provided with at least two non-metal regions, wherein a first non-metal region is located near one end of the strip, and wherein a second non-metal region is located near an opposing end of the strip.

17. The durable security device of claims 9 or 10, wherein the metal or metallic strip is provided with at least two non-metal regions, wherein a first non-metal region is located at one end of the strip, and wherein a second non-metal region is located at the opposing end of the strip, thereby forming a non-metal perimeter around the metal or metallic strip to which the protective layer(s) is adhered.

18. The durable security device of claim 1, wherein the information-bearing layer(s) is a diffractive, optically variable layer(s).

19. The durable security device of claim 1, wherein the information-bearing layer(s) is a multi-layer interference filter(s).

20. The durable security device of claim 1, wherein the information-bearing layer(s) comprises a first magnetic information-bearing layer and a second metal information-bearing layer.

21. The security device of claim 1, wherein a light-transmitting adhesive adheres the protective layer(s) to the opposing longitudinal borders of the support layer surface(s).

22. The security device of claim 21, wherein the light-transmitting adhesive is selected from the group of acrylic polymers and copolymers, modified acrylic polymers and copolymers and polyesters.

23. The security device of claim 22, wherein the light-transmitting adhesive is an acrylic polymer.

24. The security device of claim 15, which comprises two information-bearing layers, wherein the metal strips are adhered or laminated together in register such that the metal regions on one metal strip are lined up with the metal-free region(s) on the other metal strip.

25. The security device of claim 1, which further comprises at least one outer adhesive layer to facilitate incorporation of the device into or onto a security article.

26. A durable security device comprising:

(a) at least one support layer having a surface comprising a central longitudinal band or strip and opposing longitudinal borders;

(b) at least one information-bearing layer disposed on the central band or strip of the support layer surface, wherein the information-bearing layer(s) has a thickness of from about 0.001 to about 0.01 micron; and (c) at least one protective layer disposed on the information-bearing layer(s) and on the opposing longitudinal borders of the support layer surface, wherein the protective layer(s) has a thickness ranging from about 1 to about 12 microns and is adhered to at least the opposing longitudinal borders of the support layer surface.

27. A durable security device comprising:

a first and a second support layer, wherein each support layer has a surface comprising a central longitudinal band or strip and opposing longitudinal borders, two information-bearing layers each having a thickness of from about 0.001 to about 0.01 micron, wherein one information-bearing layer is disposed on the central band or strip of each support layer surface, wherein the second support layer is disposed on the information-bearing layer and on the opposing longitudinal borders of the first support layer surface, and wherein the second support layer is adhered to the opposing longitudinal borders of the first support layer surface, and a protective layer disposed on the information-bearing layer and on the opposing longitudinal borders of the second support layer, wherein the protective layer is adhered to at least the opposing longitudinal borders of the second support layer surface.

28. A security article having at least one security device at least partially embedded therein and/or mounted thereon, wherein the security device comprises;

(a) at least one support layer having a surface comprising a central longitudinal band or strip and opposing longitudinal borders;

(b) at least one information-bearing layer disposed on the central band or strip of the support layer surface, wherein the information-bearing layer(s) has a thickness of from about 0.001 to about 0.01 micron; and (c) at least one protective layer disposed on the information-bearing layer(s) and on the opposing longitudinal borders of the support layer surface, wherein the protective layer(s) is adhered to at least the opposing longitudinal borders of the support layer surface.

29. The security article of claim 28, wherein the protective layer(s) has a thickness ranging from about 1 to about 12 microns.

30. A security article having at least one security device at least partially embedded therein and/or mounted thereon, wherein the security device comprises;

(a) at least one support layer having a surface comprising a central longitudinal band or strip and opposing longitudinal borders;

(b) at least one information-bearing layer disposed on the central band or strip of the support layer surface, wherein the information-bearing layer(s) has a thickness of from about 0.001 to about 0.01 micron; and (c) at least one protective layer disposed on the information-bearing layer(s) and on the opposing longitudinal borders of the support layer surface, wherein the protective layer(s) has a thickness ranging from about 1 to about 12 microns and is adhered to at least the opposing longitudinal borders of the support layer surface.

31. A durable security device comprising:

(a) at least one support layer having a surface comprising a central longitudinal band or strip and opposing longitudinal borders;

(b) at least one information-bearing layer disposed on the central band or strip of the support layer surface, wherein the information-bearing layer(s) is a continuous or discontinuous strip having recesses in the shape of negative or reverse-image characters formed therein, and has a thickness of from about 0.001 to about 0.01 micron; and (c) at least one protective layer disposed on the information-bearing layer(s) and on the opposing longitudinal borders of the support layer surface, wherein the protective layer(s) is adhered to at least the opposing longitudinal borders of the support layer surface.

32. The durable security device of claim 31, wherein the support layer(s) and the protective layer(s) fully encapsulate at least a portion of the information-bearing layer(s).

33. The durable security device of claim 32, wherein the support layer(s) and the protective layer(s) fully encapsulate the information-bearing layer(s).

34. A durable security device consisting essentially of:

(a) at least one support layer having a surface comprising a central longitudinal band or strip and opposing longitudinal borders;

(b) at least one information-bearing layer disposed on the central band or strip of the support layer surface; and (c) at least one protective layer disposed on the information-bearing layer(s) and on the opposing longitudinal borders of the support layer surface, wherein the protective layer(s) is adhered to at least the opposing longitudinal borders of the support layer surface, and wherein the support layer(s) and the protective layer(s) fully encapsulate at least a portion of the information-bearing layer(s).

35. A durable security device consisting of:

(a) at least one support layer having a surface comprising a central longitudinal band or strip and opposing longitudinal borders;

(b) at least one information-bearing layer disposed on the central band or strip of the support layer surface; and (c) at least one protective layer disposed on the information-bearing layer(s) and on the opposing longitudinal borders of the support layer surface, wherein the protective layer(s) is adhered to at least the opposing longitudinal borders of the support layer surface and wherein the support layer(s) and the protective layer(s) fully encapsulate at least a portion of the information-bearing layer(s).

* * * * *